US005776308A

United States Patent [19]

Sears et al.

[11] Patent Number: 5,776,308

[45] Date of Patent: Jul. 7, 1998

[54] METHOD OF SOFTENING PULP AND PULP PRODUCTS PRODUCED BY SAME

[75] Inventors: Karl D. Sears, Jesup; Peter R. Abitz, St. Simons Island, both of Ga.

[73] Assignee: Rayonier Research Center, Jesup, Ga.

[21] Appl. No.: 731,142

[22] Filed: Oct. 10, 1996

[51] Int. Cl.[6] ..... D21H 17/06

[52] U.S. Cl. ..... 162/158; 162/100; 162/164.1; 162/164.7; 162/173; 264/116; 264/121

[58] Field of Search ..... 162/100, 158, 162/162, 179, 111, 112, 113, 135, 164.1, 164.7, 173; 264/116, 121

[56] References Cited

U.S. PATENT DOCUMENTS

| | | | |
|---|---|---|---|
| 2,249,118 | 7/1941 | De Witt | 91/68 |
| 4,076,896 | 2/1978 | Bunkowski | 428/530 |
| 4,144,122 | 3/1979 | Emanuelsson et al. | 162/158 |
| 4,303,471 | 12/1981 | Laursen | 162/158 |
| 4,432,833 | 2/1984 | Breese | 162/158 |
| 5,225,047 | 7/1993 | Graef et al. | 162/9 |

OTHER PUBLICATIONS

G.A. Smook, Handbook of Pulp & Paper Terminology, Angus Wild Publications Inc., pp. 129 and 137, 1990.

*Primary Examiner*—Peter Chin
*Assistant Examiner*—Steven B. Leavitt
*Attorney, Agent, or Firm*—Whitman Breed Abbott & Morgan, LLP

[57] ABSTRACT

Wood pulp sheets treated with triacetin and other compounds, or solutions or emulsions of same, having increased softness while maintaining absorbency, and methods for producing same. More particularly, the invention relates to the treatment of wood pulp useful for making a fluff pulp using a softening agent including alkyl ethers or aryl ethers and esters of low molecular weight glycols, such as triacetin, propylene glycol diacetate and 2-phenoxyethanol.

28 Claims, 3 Drawing Sheets

METHOD OF SOFTENING PULP AND PULP PRODUCTS PRODUCED BY SAME

BACKGROUND OF THE INVENTION

1. Field of the Invention

This invention relates to softened wood pulps with good absorption properties, and a process for making such pulps.

2. Description of the Related Art

It is desirable for many industrial applications to produce a cellulosic wood pulp which maximizes both softness and absorbency. The softness of a pulp product is greatly influenced by the degree to which the constituent wood pulp is debonded, i.e., the extent to which hydrogen bond, within the wood pulp are broken; softer pulps and pulp products typically having decreased hydrogen bonding. Wood pulp softness can be expressed in terms of properties such as Mullen strength (-the strength of pulp or a pulp product, measured in kilopascals (kPa), defined in greater detail below), and Kamas energy (the energy required to convert a given amount of pulp or pulp product to a fluff material, measured in watt hours per kilogram (Wh/kg), defined in greater detail below). Lower values of Mullen strength and Kamas energy correlate to softer, increasingly debonded, pulp.

Many industrial pulp applications involve the conversion of pulp to fluff pulp by mechanical means. Fluff pulp has the inherent characteristics of bulk, softness, high absorbency, and resiliency. Resiliency often depends on the length, diameter, and stiffness of the pulp fibers. Long, stiff fibers will provide greater bulk and resiliency than short, flexible fibers due to their relatively larger interfiber distances to compaction. The inter-fiber voids formed in fluff or debonded pulp determine to a large extent the absorbency of the pulp. Large void areas lead to higher absorbency since it is these void areas that hold moisture.

The efficient mechanical fluffing of wood pulp requires a pulp that will debond to a desirable degree with minimum power input and little mechanical fiber damage. Such pulp must have the proper bulk and degree of inter-fiber bonding. A hard pulp sheet will increase the power needed to create fluff pulp and will therefore lead to increased fiber damage. An unduly soft pulp sheet will lead to pull-out of large pieces of pulp, causing poor fluffing.

It is known that the use of cationic surfactants in the manufacture of wood pulp products, for instance sanitary papers, yields a product which has a soft hand feel. This is accomplished through the lubricating nature of the substantive softening molecule; less extensive inter-fiber bonding leading to greater bulk and the plasticizing effect of these additives. Cationic surface-active agents are used in the manufacture of fluffed debonded pulp to increase bulk, reduce Mullen strength (and hence, reduce inter-fiber bonding), and impart softness to fibers. The lubricating effect of these agents prevents extensive inter-fiber bonding and increases the bulk of a machine formed pulp sheet. In fluffing, such agents improve the debonding characteristics of a pulp sheet. This results in lower power requirements and less fiber damage. Reduced fiber damage produces a fluffed pulp with better bulk and resiliency.

In the manufacture of fluff or debonded cellulosic pulp, cationic surfactants are used primarily to reduce the inter-fiber bonding of pulp sheets. Reduced inter-fiber bonding is normally associated with a significant reduction in Mullen strength. Since a significant amount of energy is required to convert pulp to final fluff product, the use of debonded pulp reduces overall energy costs of conversion.

It has long been accepted in the paper making industry that pulp softening and debonding cannot be accomplished utilizing cationic surfactants (or even nonionic debonders which enjoy limited use) without sacrificing absorbency properties of wood pulp. It is generally believed that debonding pulp with hydrophobic materials, such as cationic surfactants, results in the reduction of absorbent properties. Reductions in absorbent properties using standard cationic quaternary ammonium compounds for debonding can be quite substantial (e.g., 18% reductions for a partially debonded southern bleached kraft pulp and about 27% reductions for a fully debonded southern bleached kraft pulp).

There are four cationic chemical materials used to soften pulp to produce a fluff or debonded pulp. All of these materials are quaternary ammonium compounds typified by a nitrogen ion attached by covalent bonds to four organic groups. An anion, usually a halide (e.g., a chloride) or sulfate group, is associated with the positive ion of the quaternary nitrogen. Examples of such quaternary ammonium compounds include the following generic structures:

Dialkyl Dimethyl Quarternary Ammonium Compound

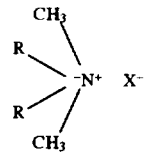

Diamido Quarternary Ammonium Compond

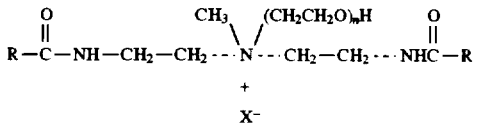

Dialkyl Quarternary Ammonium Compound

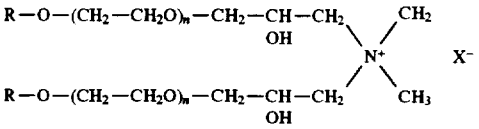

Imidazoline Quarternary Ammonium Compound

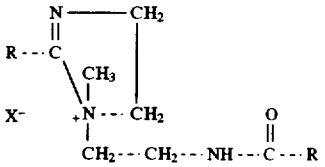

Dialkyl Phenol Alkoxylated Quarternery Ammonium Compound

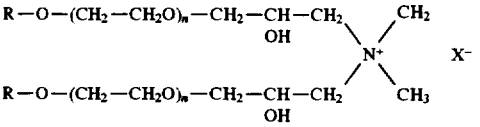

In the above drawings R is typically a C-12 to C-18 alkyl group or a C-9 aryl group, as appropriate. X is typically a halide or sulfate ion. Values for n range from 2–30.

The above-depicted cationic surface-active softening and debonding agents can be supplied as liquids, pastes, powders, solutions in water and alcohol, or solutions in water alone. However, quaternary ammonium debonding and softening agents are generally applied as dilute emulsions of water. Addition of a highly diluted emulsion is preferred since this assures uniform distribution of the debonder.

The range of surfactant treatment rates required for use as a debonding agent is usually between 3–10 pounds per ton of pulp. The range of treatment rates required for a softening agent is usually between 1–6 pounds per ton of pulp.

As one skilled in the art would recognize from reviewing the above-depicted chemical structures, there are many species of quaternary ammonium materials which can be used to improve softness and debond wood pulp. There are advantages and disadvantages to each type. However, the use of any type of quaternary ammonium compound to soften or debond cellulosic wood pulp uniformly has the disadvantage of adverse effects on absorbency.

Nonionic agents are also used to a limited extent to debond pulp in the paper industry (e.g. Berocell 587, Eka Nobel) but even they cause adverse affects on absorbency. It is believed that this effect is due to the presence of long hydrophobic side chains.

Accordingly, it would be desirable to provide a method of treating pulp to form fluff pulp with improved bulk, softness and reduced inter-fiber bonding without sacrificing the absorbent properties of the pulp.

OBJECTS OF THE INVENTION

It is an object of the present invention to overcome the above-mentioned difficulties in the prior art.

It is another object of the present invention to provide a method for improving the characteristics of a wood pulp without significantly decreasing the absorbency of the wood pulp and an improved wood pulp product by same.

It is yet another object of the present invention to provide a method for softening wood pulp.

It is a still further object of the present invention to provide a wood pulp product having improved bulk, softness and/or reduced inter-fiber bonding without decreased absorbency.

The foregoing and other objects and advantages of the invention will be set forth in or apparent from the following description.

SUMMARY OF THE INVENTION

The invention relates to the treatment of wood pulp useful for making a fluff pulp preferably for absorbency intensive applications. The invention also relates to pulp products having improved characteristics made by the inventive methods. More specifically, the invention relates to a method of treating wood pulp with a softening agent to soften the pulp without adversely effecting the absorbency of the material. Preferably, the softening agent is selected from alkyl ethers or aryl ethers (e.g., methyl ethers) and esters of low molecular weight glycols (e.g. acetates), for instance triacetin, propylene glycol diacetate and 2-phenoxyethanol, to result in a pulp that is notably softer than pulp not treated with such material. The wood pulp is treated by applying to the wood pulp a sufficient amount of a material comprising the softening agent.

When the invention is practiced industrially, the inventive softening agents are best applied to wood pulp in aqueous solution which can be made up in a holding tank or prepared continuously with an in-line static mixer. In the manufacture of absorbent pulp sheets, these agents can be added to a fiber slurry at the machine chest, fan pump or head box. They can also be applied by spray application to a wet pulp sheet or can be applied via a "dip and nip" procedure in which an evacuated but not completely dried pulp sheet is dipped into a solution containing the agent and subsequently pressed.

DESCRIPTION OF PREFERRED EMBODIMENTS

Definitions

Figure 1:
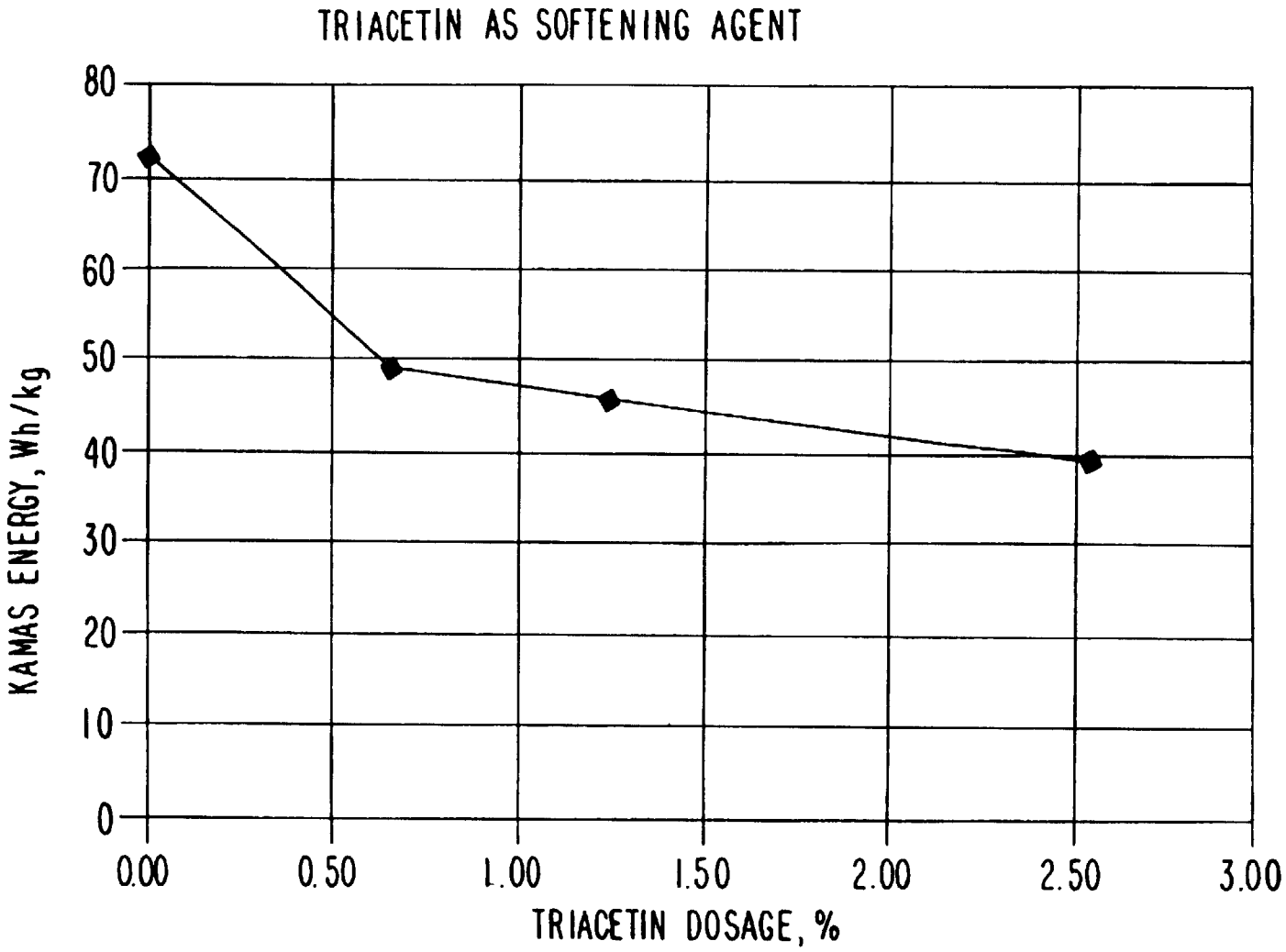
FIG. 1 illustrates a graphical representation of the dosage-Kamas energy relationship of the treatment process according to the present invention depicting triacetin dosages ranging from 0.00–2.50% applied to untreated southern pine kraft wood pulp.

The following definitions are provided to assist in understanding the true nature of the invention:

"Wood pulp" as herein described refers to a cellulosic material obtained from wood produced according to a pulping process including but not limited to sulfite, kraft and thermomechanical pulping processes, and in which lignin and other cellulose pulp impurities may be removed in whole or in part by a process which includes but is not limited to an oxidation or other bleaching process, wherein cellulosic hydroxyl groups naturally present in the cellulosic material have not been chemically substituted or derivatized. Cellulose ether and acetate end-use derivative products are not considered wood pulp.

The term "softened pulps" refers to fibrous end-use wood pulps (for example, fluff pulps) that have some chemical agent (softener) added to soften the pulp, preferably by reducing interfiber bonding (addition of the softener results in a soft pulp sheet). The chemical agents (softeners) are commercial products added to fluff pulps during sheet forming which make the pulp sheet softer and easier to fluff or defiber. The force with which pulp fibers bond is measured indirectly by measuring Mullen strength or the force (or energy) expended to debond or fluff a given pulp sheet.

"Mullen strength" refers to the hydrostatic pressure, typically measured in kilopascals, required to produce rupture of a material under certain experimental conditions. Mullen strength is determined on some of the products presented in the examples using a method based on TAPPI T807. A TMI Monitor Burst 1000 is used to measure the hydrostatic pressure required to rupture a pulp sheet. Mullen strength is recorded as kPa at rupture.

"Kamas energy" is the energy required to convert a given amount of pulp or pulp product to a fluff material measured in watt hours per kilogram (Wh/kg). A Kamas Lab hammermill Model H-01-C was used to defiberize some of the products presented in the examples. Strips of pulp sheets 5 cm wide were fed into the hammermill, using 4200 rpm motor speed, 50% feeder speed, and an 8 mm screen. The energy required to defiberize the pulp sheet is recorded, and reported as Wh/kg of fluff, the energy of defiberization.

The present invention relates to a method for improving the characteristics of a wood pulp without significantly decreasing the absorbency of the wood pulp by contacting the wood pulp with a softening agent. Preferably, the softening agent is selected from the group consisting of alkyl ethers, aryl ethers, esters of low molecular weight glycols, including materials such as triacetin, propylene glycol diacetate and 2-phenoxyethanol, having low to moderate solubility in water.

These softening agents, best represented by triacetin (glycerol triacetate), have heretofore been principally used to improve the wet stiffness of cellulose acetate filter tow, acting as a "plasticizer". (When triacetin is applied to cellulose acetate filter tow fibers, it imparts cohesive properties to the resulting filter upon compression of the fibers.) Triacetin is attractive for application to absorbent products in that it is approved for both food-grade and pharmaceutical applications. In addition to its use in stiffening acetate filter tow, triacetin is also used in the formulation of enteric coated capsules and of health care products such as creams and gels. There are no identified effects of over-exposure to triacetin related to skin contact or skin absorption. This makes the use of triacetin a particularly preferred embodiment of the invention.

Treatment of wood pulp, for instance bleached kraft southern pine pulp, with triacetin has been found to reduce Mullen strength and Kamas energy levels by 15–50%. Most significantly, little or no materially adverse effects on absorbency properties result from treatment of wood pulp with triacetin. This is a unique and novel finding since, as previously discussed, the materials previously used to soften and/or debond wood pulps, quaternary ammonium compounds, have negative performance effects on absorbency properties. Further, the softening effect was wholly unexpected as triacetin is used as a stiffener for cellulose acetate tow for cigarette filters.

Moreover, it has been found that treatment of wood pulp with alkyl or aryl ethers and esters of low molecular weight glycols which have low to moderate solubility in water, for instance, not greater than 50 g per 100 g solution, is most effective in softening wood pulp, as compared to members of the same class of compounds having high solubility in water. It should be noted that application of a softening agent to wood pulp is not limited to application in solution, and can also include application in pure form, or as an emulsion, suspension or dispersion.

In another aspect of this invention, a softening agent selected from the group consisting of alkyl ethers, aryl ethers, esters of low molecular weight glycols and mixtures thereof may be added to wood pulp to soften the wood pulp without regard to the effect, if any, of the softening agent on wood pulp absorbency.

In a further aspect of this invention, triacetin, propylene glycol diacetate, 2-phenoxyethanol and mixtures thereof may be added to wood pulp to soften the wood pulp without regard to the effect, if any, of the softening agent on wood pulp absorbency.

There is no prior art to suggest that the above-identified family of compounds can be used to soften wood pulp. Further, the discovery that triacetin can accomplish softening (i.e., reductions in Mullen strength) without negatively affecting absorbency properties contradicts conventional industry practice and knowledge.

As the materials that work best in this invention are those that have limited water solubility, it is a preferred embodiment of the present invention to treat wood pulp with materials having solubility in water of no more than 50 g per 100 g solution, more preferably no greater than 15 g per 100 g solution, and even more preferably no greater than 9 g per 100 g solution.

Various types of wood pulp (in sheet form) were tested to measure the effect that the softening agents of the present invention had on properties including Mullen strength, Kamas energy, absorption time and fluid retention. It was found that each of triacetin, propylene glycol diacetate and 2-phenoxyethanol reduce Kamas energy, reduce Mullen strength, and have a negligible effect on both absorption time and fluid retention properties.

In light of the examples discussed below, and the data contained therein, the present invention provides a softened pulp wherein the Kamas energy of the pulp preferably reduced by 5 Wh/kg, more preferably is reduced by 15 Wh/kg and most preferably was reduced by 25 Wh/kg or more.

Further, the present invention provides for a softened pulp wherein the Kamas energy of the pulp preferably is reduced by 5%, more preferably by 10%, even more preferably by 20%, even more preferably still by 30%, and most preferably by 40%.

The present invention likewise provides a softened pulp wherein the Mullen strength is reduced by 100 kPa, more preferably reduced by 200 kPa, and most preferably reduced by 400 kPa or more.

Further, the present invention provides for a softened pulp wherein the Mullen strength preferably is reduced by 5%, more preferably by 10%, even more preferably by 20%, more preferably still by 30%, even more preferably still by 40%, and most preferably by 50%.

Further, the absorption time of the softened pulps of the present invention preferably increases by no more than 0.50 seconds, more preferably by no more than 0.25 seconds, and most preferably, not at all.

Moreover, the retention of the softened pulps of the present invention, measured in grams retained per gram of pulp (g/g), preferably decreases by no more than 0.50 g/g, more preferably by no more than 0.25 g/g and most preferably, not at all.

Without being limited to a specific theory of operability, it is believed that hydrophobicity, an inherent quality which causes the materials of the present invention to possess only low to moderate solubility, is also responsible for the ability of these materials to interfere with intrafiber and interfiber hydrogen bonding. It is further believed that the increased interference with hydrogen bonding of low to moderate solubility is effected as follows: Because, for practical reasons, wood pulp is never fully (100%) dried, high solubility materials will remain to a large extent in solution even at substantial pulp dryness. Low to moderate solubility materials will not remain in solution, and will thus be able to more directly affect hydrogen bonding.

According to one preferred embodiment, the softening agent comprises triacetin. Triacetin appears to be the most effective in softening and debonding wood pulp, as shown by the data set forth in the examples below. Triacetin has a solubility of 7 g–7.8 g per 100 g solution (at 2°–75° C.). Other effective materials include propylene glycol diacetate, which has a room temperature solubility of approximately 8 g per 100 g solution, and 2-phenoxyethanol, which has a room temperature solubility of approximately 3 g per 100 g solution. On the other hand, triethylene glycol diacetate (TEGDA), which (like triacetin) is a stiffener for cellulose acetate filter tow, but (unlike triacetin and the other softening agents disclosed herein) is completely water soluble, is not effective in softening or debonding pulp (see Example 3, below).

Triacetin does not have long hydrophobic side chains such as those exhibited by the conventional cationic softener as well as nonionic softeners presently used in the industry. Without being limited to a theory of operability, it is believed that this is a factor that mitigates negative absorption affects.

According to another embodiment, the softening agents comprise alkyl or aryl ethers (e.g., methyl ethers) and ethanoic and propanoic esters of low molecular weight glycols (e.g., acetates) of low to moderate water solubility, such as propylene glycol diacetate and 2-phenoxyethanol, which are also effective in softening kraft wood pulps.

The softening agents discussed above can be applied to wood pulp in a number of ways. One embodiment of the present invention relates to a method for softening wood pulp comprising the steps of applying the softening agent dipping the wood pulp into a solution containing the softening material, pressing the wood pulp, and drying the wood pulp. Another embodiment relates to a method for softening wood pulp comprising the steps of adding the softening agent to a wood pulp slurry. Yet another embodiment of the present invention relates to a method comprising the step of spraying the softening material onto the wood pulp.

The present invention also relates to compositions of matter produced by application of the presently disclosed softening agents to wood pulp. One embodiment of the present invention provides a composition of matter comprising treated wood pulp, wherein the wood pulp is treated by applying to wood pulp a sufficient amount of a material selected from the group consisting of alkyl ethers, aryl ethers, esters of low molecular weight glycols, each having solubility in water of no more than 50 g per 100 g solution.

Another preferred embodiment of the present invention thus provides for a composition of matter comprising treated wood pulp, wherein said wood pulp is treated by applying to wood pulp a sufficient amount of a material selected from the group consisting of triacetin, propylene glycol diacetate, and 2-phenoxyethanol.

Individual features or a plurality of individual features describing the inventive products or processes can also themselves form independent solutions according to the invention and one or more of the features can also be combined in any way.

EXAMPLES

Each of examples 1–8 described below demonstrate the surprising and advantageous results obtained by treating pulp with the presently disclosed softening agents (Example 3 is comparative); that is, a dramatic decrease in Mullen strength and/or a dramatic decrease in Kamas energy without the significant decrease in absorbency times and liquid retention associated with the conventional cationic or nonionic surfactants presently used as softening agents in the pulping industry.

Test Procedures & Definitions

In the tests described hereinafter, industry-employed standard test procedures have been used. If any deviations from standard test procedure have been made, such deviations have been identified.

For purposes of evaluating the products obtained and described by the present disclosure as well as the invention herein, several tests were used to characterize the desirable fibrous wood pulp end-use performance improvements resulting from use of the presently disclosed softening agent treatment, and to describe some of the analytical properties of the pulp products. A summary of these tests and definitions follows:

"Rayfloc-J-LD" is an untreated southern pine kraft pulp sold by Rayonier Inc. for use in applications requiring high absorbency.

"Rayfloc-J-LD-E" is an untreated southern pine kraft pulp sold by Rayonier Inc. for use in applications requiring high absorbency. Rayfloc-J-LD-E differs from Rayfloc-J-LD only by its being processed principally without the use of elemental chlorine.

"Rayfloc-J" and "Rayfloc-J-E" are slightly different versions of "Rayfloc-J-LD" and "Rayfloc-J-LD-E".

"SCAN testing" of fluff pulp properties are carried out on some of the products presented in the examples. The test uses SCAN/PFI methodology (SCAN-C 33:80) and test equipment to form a uniform fluff sample, and to measure its resiliency, fluid retention and rate of absorption. The fluff samples are conditioned for at least 2 hours under standard conditions (23+/−1 degree C. and 50%+/−2% relative humidity) prior to testing and are kept in the conditioning atmosphere throughout the test.

Typically, a cylindrical fluff sample (3.00+/−0.05 g and 5 cm diameter) is prepared using special equipment. The height of the cylinder under a 260 g/1.3 kPa load is measured and reported as resiliency. The sample is placed in contact with a water bath. The time required for the water to migrate vertically up the cylinder to the top is reported as absorption time. The fluid retention or absorption capacity per gram of sample is calculated by weighing the saturated fluff sample.

"Pad Integrity" tests are carried out on some of the products presented in the examples. Pad integrity is a measure of the strength of the fiber network in fluffed pulps, and indicates how well the fluff will maintain pad integrity in a dry formed absorbent product. The method is based on PFI method 1981, "Measurement of Network Strength in Dry, Fluffed pulps". During the test, a cylindrical test pad of 1.0+/−0.05 gram and 50 mm diameter is prepared in a pad former. The test pad is placed in a burst chamber, which is then installed in a stress-strain apparatus. A burst body is vertically forced through the test pad. The force required to rupture the fiber network in the test pad is reported as pad integrity.

Several experiments were conducted to demonstrate the effects of triacetin on the aforementioned debonding and absorbency properties of wood pulp.

The following examples are illustrative of some of the methods and products made from the methods falling within the scope of the present invention. They are, of course, not to be considered in any way limitative of the invention. Numerous changes and modifications can be made with respect to the invention.

Example 1

Figure 2:
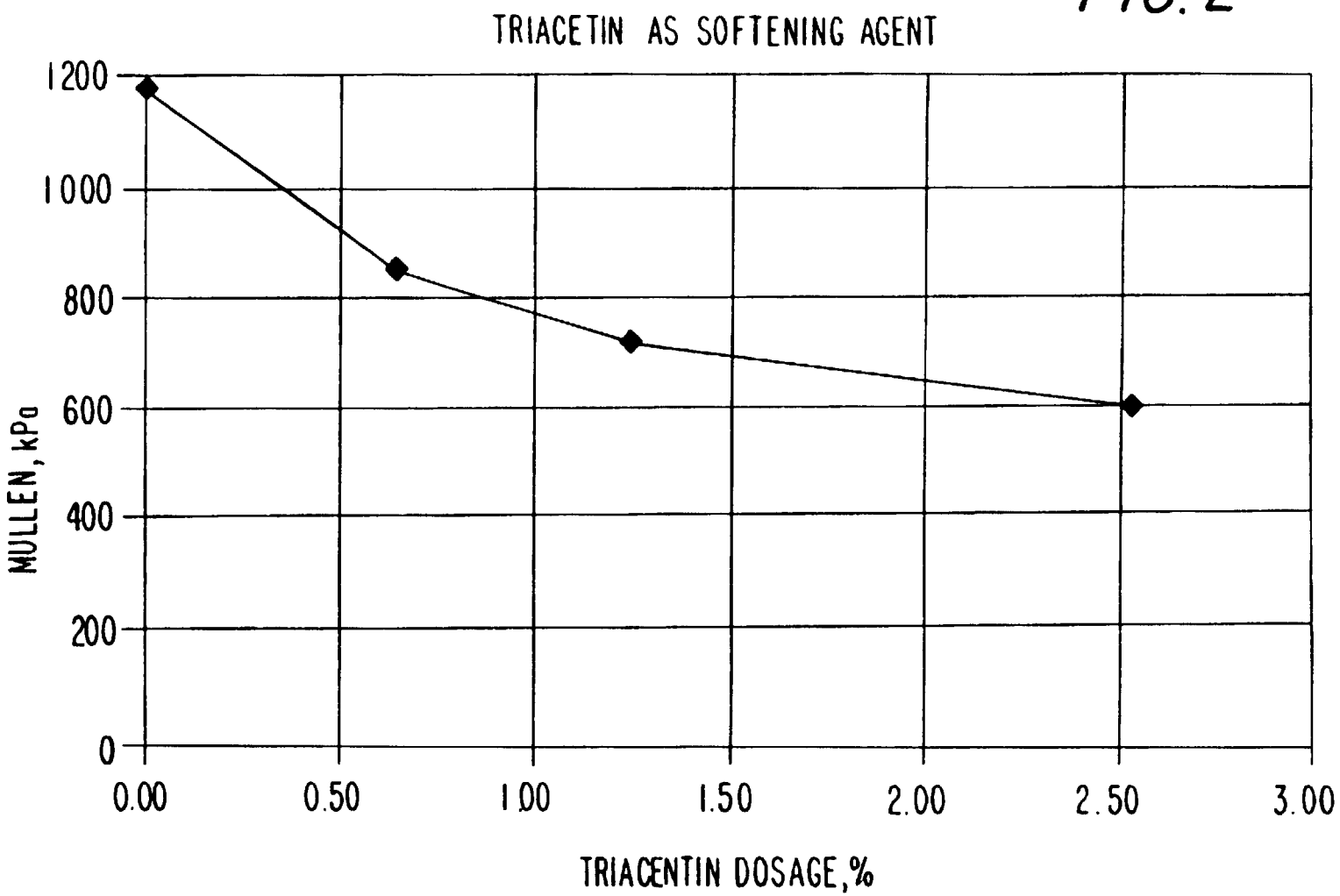
FIG. 2 illustrates a graphical representation of a dosage-Mullen strength relationship of the treatment process according to the present invention depicting triacetin dosages ranging from 0.00–2.50% applied to untreated southern pine kraft wood pulp, with the control pulp having a Kamas energy level of 72.2.

Highly absorbent southern pine kraft pulp, in the form of Rayfloc-J-LD-E pulp sheets, was treated with various triacetin levels ranging from 0.66–2.54% by weight of O.D. (oven dried) pulp. These samples were prepared by immersing dry machine-made pulp sheets in an aqueous solution of triacetin and then mechanically pressing the sheets to about 47% dryness. The amount of triacetin remaining in the wet pulp sheet after pressing was readily calculated from the increased weight of the wet sheet. The wet pulp sheets were placed into a hot Emerson dryer for about 30 minutes and brought to near dryness (~95% O.D.). By way of an illustration, a sheet weighing 59.7 g O.D. was placed into a solution containing a 2.4% solution of triacetin. After pressing, the same sheet weighed 123 g. This corresponds to a dose rate of 2.54%, assuming that all the triacetin in solution stays with the pulp on drying. Since triacetin boils at 258° C., this is a reasonable assumption. Results of evaluations on these pulps are presented in Table I, below, and in FIGS. 1 and 2.

TABLE I

Treatment of Rayfloc-J-LD-E Pulpsheets With Triacetin

| | Triacetin | Sheet properties | | Kamas Fluff Properties | | | | |
|---|---|---|---|---|---|---|---|---|
| Sample | Added % by wt. | K Energy Wh/kg | Mullen kPa | Resiliency cm | Abs. Time s | Heat Aged Abs. Time s | Retention g/g | Pad Integrity N |
| I-1 | 0.0 (control) | 72.2 | 1181 | 4.4 | 5.7 | 8.8 | 14.6 | 8.7 |
| I-2 | 2.54 | 39.0 | 595 | 4.5 | 5.4 | 5.7 | 14.2 | 10.0 |
| I-3 | 1.26 | 45.4 | 721 | 4.4 | 5.2 | 6.6 | 14.6 | 10.0 |
| I-4 | 0.66 | 49.4 | 848 | 4.4 | 4.5 | 6.6 | 14.3 | 8.4 |

Over the triacetin treatment range (of 0.6–2.5%) based on dry pulp, Kamas energy and Mullen strength were reduced by about 30 to 50%, with no negative impact on absorbency. SCAN absorbency characteristics including pad integrity were equal to the control pulp. Heated aged absorption times were actually improved in the treated pulps.

Clearly, triacetin has a marked ability to increase pulp softness and to ease the defibering of pulp as reflected by the reductions in Mullen strength that it imparts. When a wood pulp is relatively hard prior to treatment with the inventive compositions, this Mullen strength reduction effect is accompanied by significant Kamas energy reduction in preparation of Fluff for absorbent products.

Example 2

Figure 3:
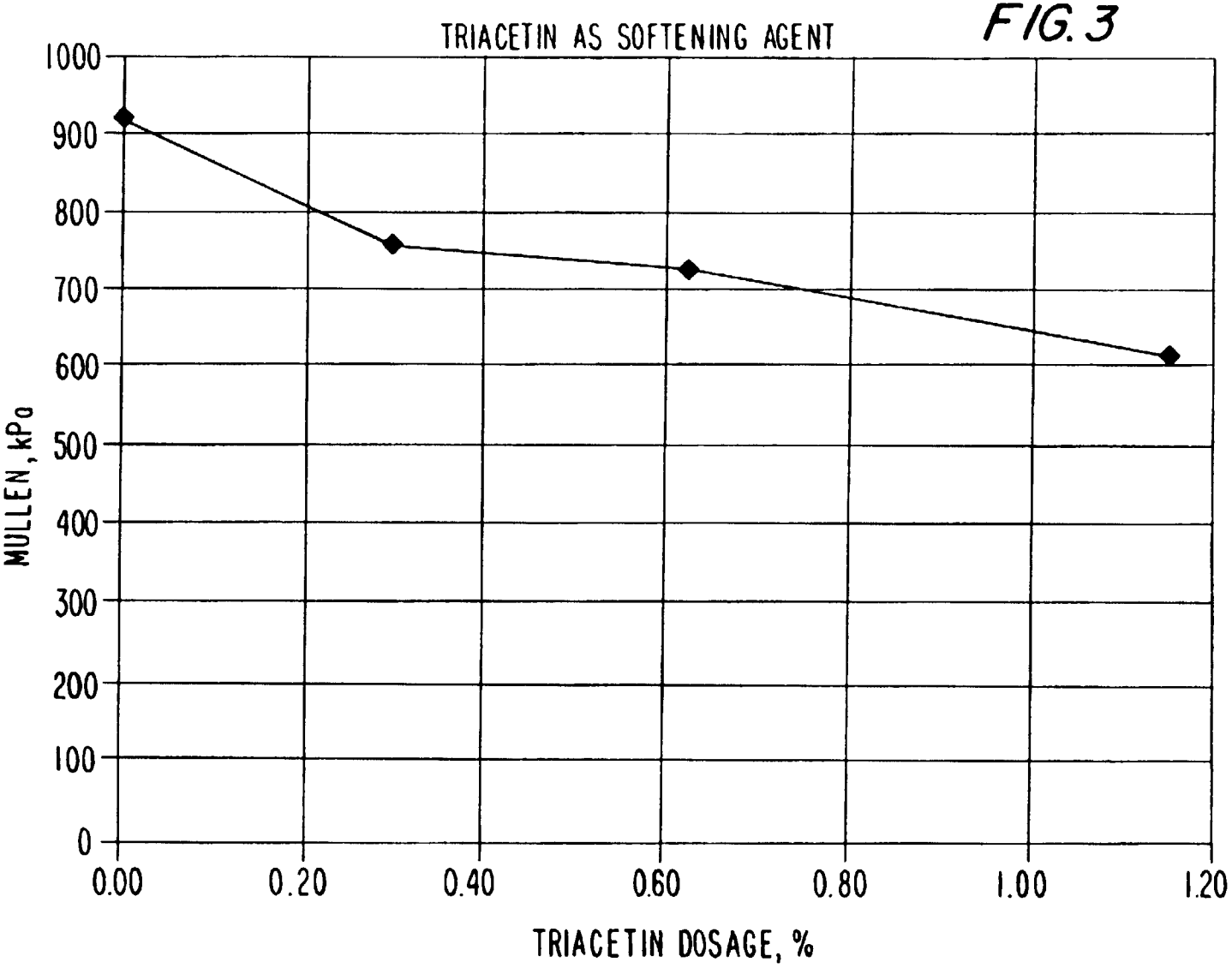
FIG. 3 illustrates a graphical representation of a dosage-Mullen strength relationship of the treatment process according to the present invention depicting triacetin in dosages ranging from 0.00–1.20% by weight applied to untreated southern pine kraft wood pulp, with the control pulp having a Kamas energy level of 55.6.

Untreated southern pine kraft pulp, in the form of Rayfloc-J-LD sheets, was treated with triacetin in the 0.3–1.2% range in the same manner as Example 1. The results of fluff absorbency tests on these samples, including Kamas energy and Mullen strength values, are presented in Table II, below, and in FIG. 3.

The control pulp itself, in this case, had a lower Kamas energy level (55.6) compared to the control in Example 1 (72.2). For this reason, the Kamas energy reductions are not as notable as they were in Example 1, but they are clearly discernable at the 1.16% dosage level. However, the Mullen strength reductions observed are notable over the full range of dosing and consistent with the trends previously observed. At the 0.3% dosage level, for instance, the Mullen strength reduction was about 17%.

Over the dosage range of 0.3–1.2%, Mullen strengths were reduced by about 17–33%. There were no adverse effects on fluff absorbency properties, such as would have been found had the same pulp been treated with cationic surfactants to equivalent softness.

Example 3

Absorbent southern pine kraft pulp, in form of Rayfloc-J-LD sheets, was treated with TEGDA (triethylene glycol diacetate), to yield pulp sheets with TEGDA dosages in the 0.6–2.6% range, using the method described in Example 1 above. These sheets were tested to determine their Mullen strength, Kamas energy, absorption time and retention. The results are shown at Table III.

TABLE II

Treatment of Rayfloc-J-LD Pulp Sheets with Triacetin

| | Triacetin | Sheet Properties | | Kamas Fluff Properties | | | |
|---|---|---|---|---|---|---|---|
| Sample | Added % by wt. | K. Energy Wh/kg | Mullen kPa | Resiliency cm | Abs. Time s | Heat Aged Abs. Time s | Rentention g/g |
| II-1 | 1.16 | 42.8 | 613 | 5.0 | 5.8 | 8.1 | 15.9 |
| II-2 | 0.63 | 52.0 | 727 | 5.2 | 5.7 | 7.7 | 15.8 |
| II-3 | 0.30 | 50.3 | 756 | 5.4 | 6.6 | 7.5 | 16.1 |
| II-4 | 0.0 (control) | 55.6 | 911 | 5.1 | 5.7 | 7.5 | 15.7 |

TABLE III

Treatment of Rayfloc-J-LD Pulp Sheets with TEGDA

| | TEGDA | Sheet Properties | | Kamas Fluff Properties | | | | |
|---|---|---|---|---|---|---|---|---|
| Sample | Added % by wt. | K. Energy Wh/kg | Mullen kPa | Resiliency cm | Abs. Time s | Heat Aged Abs. Time s | Retention g/g | Pad Integrity N |
| III-1 | 0.0 (control) | 50.3 | 678 | 4.7 | 6.4 | 9.0 | 15.0 | 10.4 |
| III-2 | 2.58 | 39.2 | 657 | 4.6 | 5.1 | 6.6 | 14.4 | 9.2 |
| III-3 | 1.34 | 46.3 | 691 | 4.6 | 5.3 | 6.5 | 14.9 | 8.0 |

The above tabulated results show no effect on Mullen strength. No significant Mullen reductions occurred as a result of treatment with TEGDA. This material is less effective than triacetin. As postulated previously, this lack of effectiveness may be related to a lack of hydrophobic character of TEGDA compared to triacetin and other substances effectively used in the present invention.

Example 4

Triacetin and other alkyl and aryl ethers and esters of low molecular weight glycols with low to moderate water solubility are added to southern pine kraft wood pulp slurries at the machine chest, fan pump or head box of a sheet forming machine. Pulp sheets are formed from the treated pulps by standard methods, and the physical properties of these sheets are tested by accepted industry methods, described above, for Mullen strength, Kamas energy, absorption time and retention. It is noted that Mullen strength and Kamas energy of the treated pulps are reduced for concentrations of softening agent in the range of 0.1% to 10.0% by weight, while absorption time values and retention values are maintained without a significant decrease.

Example 5

Triacetin, and other alkyl and aryl ethers, and esters of low molecular weight glycols with low to moderate water solubility are sprayed onto an evacuated but not yet dried sheets of absorbent southern pine kraft wood pulp. The pulp sheets are dried after treatment with the softening agents. The physical properties of the pulp sheets are tested by accepted methods described above for Mullen strength, Kamas energy, absorption time and retention. It is noted that Mullen strength and Kamas energy are reduced for concentration of softening agents in the range of 0.1% to 10.0% by weight, while absorption time values and retention values are maintained without a significant decrease.

Example 6

Evacuated but not yet dried sheets of absorbent southern pine kraft pulp are dipped into solutions of triacetin, and other alkyl and aryl ethers and esters of low molecular weight glycols with low to moderate water solubility at various concentrations and then pressed and subsequently oven dried. The physical properties of the treated sheets are tested as described above for Mullen strength, Kamas energy, absorption time, and retention. It is noted that Mullen strength and Kamas energy are reduced for concentration of softening agents in the range of 0.1% to 10.0% by weight, while absorption time values and retention values are maintained without a significant decrease.

Example 7

Propylene glycol diacetate and triacetin were separately applied to southern pine kraft pulp, in form of Rayfloc-J sheets. The pulp sheets were dipped into aqueous solutions of propylene glycol diacetate or triacetin, then blotted with paper toweling to remove excess water. The sheets were then weighed and hung up in a hood to air dry.

More specifically, the aforedescribed pulp sheets, supported on a flexible wire-mesh screen, were dipped into an aqueous solution containing either 1.1% by weight propylene glycol diacetate or 1.1% by weight triacetin for 45 seconds. After blotting with paper toweling, applied under and over the sheet to remove excess water, the wet sheet weight was obtained and the sample was hung up in a hood to air-dry. A control group consisted of untreated Rayfloc-J pulp sheets.

The Rayfloc-J pulp sheets treated with either the propylene glycol diacetate or the triacetin were softer to the touch, as well as bulkier, than control sheets without propylene glycol diacetate or triacetin.

As detailed in the below Table IV, there were no statistically significant negative effects on absorption for wood pulps treated with propylene glycol diacetate or triacetin.

TABLE IV

Treatment of Rayfloc-J with Triacetin and Propylene Glycol Diacetate (PGDAc)

| | | Sheet Properties | | Kamas Fluff Properties | | |
|---|---|---|---|---|---|---|
| Sample | Treatment % | K. Energy Wh/kg | Mullen kPa | Resiliency cm | Fluid Ret. g/g | Abs. Time s |
| IV-1 | 0.0 (Control) | 49.7 | 1051 | 4.2 | 15.6 | 15.0 |
| IV-2 | 1.1 Triacetin | 32.8 | 797 | 4.1 | 16.1 | 10.9 |
| IV-3 | 1.1 PGDAc | 43.5 | 991 | 4.2 | 16.0 | 11.0 |

Kamas energy was reduced from 49.7 Wh/kg (control) to 43.5 Wh/kg (a 12% reduction) with treatment with PGDAc. Mullen strength was likewise reduced from 1051 kPa to 991 kPa (a 6% reduction). In all cases, these wood pulp sheets were observed to be softer and thicker, and improved absorption times actually appeared from the treatment of the pulp sheets with propylene glycol diacetate or triacetin (10.9 seconds for triacetin, all 11.0 seconds for PGDAc, as compared to 15.0 seconds for the control).

Example 8

2-phenoxyethanol and triacetin were separately applied to southern pine kraft pulp, in the form of Rayfloc-J-E sheets. The pulp sheets were dipped into aqueous solutions of 2-phenoxyethanol or triacetin, then blotted with paper toweling to remove excess water. The sheets were then weighed and hung up in a hood to air dry.

More specifically, the aforedescribed pulp sheets, supported on a flexible wire-mesh screen, were dipped into an aqueous solution containing either 1.1% by weight 2-phenoxyethanol or 1.0% by weight triacetin for 45 seconds. After blotting with paper toweling, applied under and over the sheet to remove excess water, the wet sheet weight was obtained and the sample was hung up in a hood to air-dry. A control group consisted of untreated Rayfloc-J-E pulp sheets.

The Rayfloc-J-E pulp sheets treated with either the propylene glycol diacetate or the triacetin were softer to the touch, as well as bulkier, than control sheets without 2-phenoxyethanol or triacetin.

As detailed in the below Table V, there were no statistically significant negative effects on absorption for wood pulps treated with 2-phenoxyethanol or triacetin.

TABLE V

Treatment of Rayfloc-J with Triacetin and 2-Phenoxyethanol (2-PETOH)

| | | Sheet Properties | | Kamas Fluff Properties | | |
|---|---|---|---|---|---|---|
| Sample | Treatment % | K. Energy Wh/kg | Mullen kPa | Resiliency cm | Fluid Ret. g/g | Abs. Time s |
| V-1 | 0.0 (Control) | 52.2 | 1029 | 4.0 | 15.3 | 7.2 |
| V-2 | 1.1 2-PETOH | 41.8 | 988 | 4.0 | 15.3 | 6.4 |
| V-3 | 1.0 Triacetin | 40.0 | 830 | 4.2 | 15.3 | 7.2 |

Kamas energy was reduced from 52.2 wh/kg to 41.8 wh/kg with 2-PETOH treatment (a 20% reduction). Mullen was likewise reduced from 1029 kPa to 830 kPa (a 19% reduction). In all cases, these wood pulp sheets were observed to be softer and thicker, with no negative absorption effects from the treatment of the pulp sheets with 2-phenoxyethanol or triacetin.

The above descriptions of the inventions are intended to be illustrative and not limiting. Various changes or modifications in the embodiments described may occur to those skilled in the art. These can be made without departing from the spirit or scope of the invention.

We claim:

1. A method of softening a wood pulp comprising the step of contacting the pulp with a softening agent selected from the group consisting of triacetin, propylene glycol diacetate, 2-phenoxyethanol, and mixtures thereof, wherein the Mullen strength of the pulp is decreased by at least 5%, the Kamas energy of the pulp is decreased by at least 5%, and the relative liquid absorption rate is not decreased by more than 5%.

2. The method as defined in claim 1, wherein said softening agent has a solubility in water of less than 50 g per 100 g aqueous solution at 75° C.

3. The method as defined in claim 1, wherein said method is useful for making a fluff pulp or a pulp for absorbency intensive applications.

4. A method defined in claim 1, wherein said softening agent has a solubility in water of no greater than 15 g per 100 g aqueous solution at 75° C.

5. The method defined in claim 1, wherein applying said softening agent comprises the steps of:

applying said softening agent to a sheet of said wood pulp;

pressing said wood pulp sheet; and, drying said wood pulp sheet.

6. The method of claim 1 wherein the step of applying said softening agent comprises adding said softening agent to a wood pulp slurry.

7. The method of claim 1, wherein the step of applying said softening agent comprises spraying said softening agent onto a sheet of wood pulp.

8. The method defined in claim 1, wherein said wood pulp is a pulp sheet.

9. The method defined in claim 1, wherein the amount of said softening agent applied to said wood pulp is no greater than 5% by weight.

10. The method defined in claim 1, wherein the amount of said softening applied to said wood pulp is no greater than 3% by weight.

11. The composition of matter produced according to the method of claim 1.

12. The method defined in claim 1, wherein said pulp is contacted with a material consisting essentially of said softening agent.

13. A method of softening a wood pulp comprising the step of contacting the pulp with a softening agent selected from the group consisting of triacetin, propylene glycol diacetate, 2-phenoxyethanol and mixtures thereof wherein the Mullen strength of the pulp is decreased by at least 5%, the Kamas energy of the pulp is decreased by at least 5%, and the relative liquid absorption rate is not decreased by more than 5% and said softening agent has a solubility in water of less than 50 g per 100 aqueous solution at 75° C. and the amount of said softening agent contacted with said wood pulp is no greater than 5% by weight.

14. A method of softening a wood pulp comprising the step of contacting the pulp with an effective amount of a softening agent comprising triacetin, wherein the Mullen strength of the pulp is decreased by at least 5%, the Kamas energy of the pulp is decreased by at least 5%, and the relative liquid absorption rate is not decreased by more than 5%.

15. The method defined in claim 14, wherein said wood pulp is a pulp sheet.

16. The method defined in claim 14, wherein the amount of said softening agent applied to said wood pulp is no greater than 5% by weight.

17. The method defined in claim 14, wherein the amount of said softening applied to said wood pulp is no greater than 3% by weight.

18. The method defined in claim 14, wherein said pulp is contacted with a material consisting essentially of said softening agent.

19. A method of softening wood pulp comprising the step of applying to a wood pulp a softening agent selected from the group consisting of triacetin, propylene glycol diacetate, 2-phenoxyethanol, and mixtures thereof, having solubility in water of less than 50 g per 100 g aqueous solution at 75° C.

20. A method of softening wood pulp comprising the step of applying to a wood pulp a softening agent selected from the group consisting of triacetin, propylene glycol diacetate, 2-phenoxyethanol or mixtures thereof.

21. A composition of matter comprising treated wood pulp produced by a method comprising the step of applying to wood pulp a sufficient amount of a softening agent selected from the group consisting of triacetin, propylene glycol diacetate, 2-phenoxyethanol, and mixtures thereof, having solubility in water of no more than 50 g per 100 g aqueous solution at 75° C.

22. A composition of matter comprising treated wood pulp produced by a method comprising the step of applying to wood pulp a sufficient amount of a softening agent selected from the group consisting of triacetin, propylene glycol diacetate, 2-phenoxyethanol and mixtures thereof.

23. A composition of matter produced according to a method comprising the steps of:

dipping wood pulp into a solution containing a softening agent selected from the group consisting of triacetin, propylene glycol diacetate, 2-phenoxyethanol, and mixtures thereof, said softening agent having solubility in water of no more than 50 g per 100 g aqueous solution at 75° C.;

pressing said wood pulp; and, drying said wood pulp.

24. A wood pulp composition produced by adding a softening agent selected from the group consisting of triacetin, propylene glycol diacetate, 2-phenoxyethanol, and mixtures thereof, said softening agent having solubility in water of no more than 50 g per 100 g aqueous solution at 75° C., to a wood pulp slurry.

25. A wood pulp composition produced by spraying a softening agent, selected from the group consisting of triacetin, propylene glycol diacetate, 2-phenoxyethanol, and mixtures thereof, said softening agent having solubility in water of no more than 50 g per 100 g aqueous solution at 75° C., onto wood pulp.

26. A composition of matter produced according to a method comprising the steps of:

dipping wood pulp into a solution containing a softening agent selected from the group consisting of triacetin, propylene glycol diacetate, 2-phenoxyethanol and mixtures thereof;

pressing said wood pulp; and, drying said wood pulp.

27. A wood pulp composition produced by adding a softening agent selected from the group consisting of triacetin, propylene glycol diacetate, 2-phenoxyethanol and mixtures thereof to a wood pulp slurry.

28. A wood pulp composition produced by spraying a softening agent selected from the group consisting of triacetin, propylene glycol diacetate, 2-phenoxyethanol and mixtures thereof onto wood pulp.

* * * * *